United States Patent [19]

Niemann et al.

[11] 4,302,943

[45] Dec. 1, 1981

[54] METHOD OF MEASURING HEAT INFLUX OF A CRYOGENIC TRANSFER SYSTEM

[75] Inventors: Ralph C. Niemann, Downers Grove; Steven A. Zelipsky, Tinley Park; Ronald R. Rezmer, Lisle, all of Ill.; Peter Smelser, Bruner, Mo.

[73] Assignee: The United States of America as represented by the United States Department of Energy, Washington, D.C.

[21] Appl. No.: 201,947

[22] Filed: Oct. 29, 1980

[51] Int. Cl.[3] ..... F17C 13/02

[52] U.S. Cl. ..... 62/49; 62/129; 73/204; 73/295; 73/304 R; 137/392

[58] Field of Search ..... 62/49, 125, 129; 73/204, 295, 304 R; 137/392

[56] References Cited

U.S. PATENT DOCUMENTS

| | | | |
|---|---|---|---|
| 3,938,347 | 2/1976 | Riedel et al. | 62/49 |
| 4,059,424 | 11/1977 | Bentz | 62/49 |
| 4,135,548 | 1/1979 | Sears | 137/392 |
| 4,192,147 | 3/1980 | Gilbert et al. | 73/295 |

*Primary Examiner*—Ronald C. Capossela

*Attorney, Agent, or Firm*—Bruce R. Mansfield; Paul A. Gottlieb; Richard G. Besha

[57] ABSTRACT

A method is provided for measuring the heat influx of a cryogenic transfer system. A gaseous phase of the cryogen used during normal operation of the system is passed through the system. The gaseous cryogen at the inlet to the system is tempered to duplicate the normal operating temperature of the system inlet. The temperature and mass flow rate of the gaseous cryogen is measured at the outlet of the system, and the heat capacity of the cryogen is determined. The heat influx of the system is then determined from known thermodynamic relationships.

9 Claims, 2 Drawing Figures

METHOD OF MEASURING HEAT INFLUX OF A CRYOGENIC TRANSFER SYSTEM

CONTRACTUAL ORIGIN OF THE INVENTION

The United States Government has rights in this invention pursuant to Contract No. W-31-109-ENG-38 between the U.S. Department of Energy and Argonne National Laboratory.

BACKGROUND OF THE INVENTION

This invention pertains to a method of measuring heat influx of cryogenic systems, particularly those systems containing a cryogen flow.

Cryogenic transfer systems usually consist of an inner conductor portion maintained at cryogenic temperatures, surrounded by one or more insulated layers that thermally isolate the cryogenic conductor portion from the environment surrounding the system. The insulating layers may include circulating liquid or gaseous cryogen systems, or may include static systems, such as a blanket of aluminized mylar. Despite the careful design of such insulation systems, heat influx into the cryogenic portions is inevitably experienced during operation of the cryogenic system. If the heat influx exceeds a critical level, cryogenic temperatures necessary for successful operation the system cannot be maintained. It therefore becomes necessary to accurately measure the heat influx of a cryogenic system.

One such cryogenic system is commonly termed a "bayonet" type transfer line or interconnection between a cryogenic dewar, or source of cryogen, and a cryogenic apparatus which receives the cryogen. Such bayonet transfer lines usually assume an inverted U-shaped configuration. Prior testing methods of such bayonet transfer lines require the transfer lines to be disconnected and inverted, to present a generally U-shaped configuration. Liquid nitrogen, a relatively inexpensive cryogen, is then poured into a first end of the transfer line to fill as much of the transfer line as possible. One end of the transfer line is then sealed, and a gas flow meter is installed at the other end. The gas flow meter measures the liquid nitrogen boil-off which results from any heat influx into the transfer line. The mass flow rate of the liquid nitrogen boil-off is then empirically related to a heat influx rate.

This method is used for transfer lines carrying both nitrogen as well as helium cryogen, since the amount of boil-off of liquid helium would be prohibitively expensive, were that cryogen used during the measurement. Several problems are encountered when nitrogen cryogen is used to measure the heat influx of helium transfer lines. The heat flux into a helium transfer line has components of internal gas conduction, thermal radiation, and conduction experience at the end of the transfer line. There is no known theory of thermodynamics that will predict the operation of a helium system, given the parameters of operation of the same system, but with a nitrogen cryogen.

Another difficulty encountered with the aforementioned test method, is that the transfer line must be inverted so as to provide a receptacle for the liquid nitrogen poured therein. It is particularly difficult using the aforementioned test method to accurately measure the heat influx of a bayonet-type transfer line having one or more vertical bayonet connections. In a vertical bayonet connection, a male bayonet component is oriented to point in a downward position, with the transfer line inlet/outlet at the bottom-most portion of the bayonet. When installed in a transfer system, the male bayonet is received within an upwardly extending female bayonet component, having an opening at its uppermost portion. A column of cryogen gas extends the entire length of the bayonet connection, acting as an effective thermal insulator between the free end of the male bayonet and the surrounding environment. When the transfer line is disconnected and inverted, the gas column insulating the male bayonet is destroyed. It then becomes impossible using the aforementioned test method to measure the heat influx of the male bayonet portion of the transfer line assembly. This restriction is undesirable since the heat influx of the male bayonet very often represents the majority of the total transfer line heat influx. A more meaningful evaluation of a transfer line's thermal stability could be realized if the transfer line were tested in its normal operating position, with its test connections made as similar as possible to its operating connections.

It is therefore an object of the present invention to provide a heat influx measurement method wherein the cryogenic transfer line is maintained in its normal operating position with test connections similar to the transfer lines operating connections.

It is another object of the present invention to provide a heat influx test method utilizing the operating cryogen, maintaining that cryogen at the actual operating temperature.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

These and other objects of the present invention are achieved by providing a heat influx measurement method in which the cryogenic transfer system to be measured is maintained in its normal operating condition. For example, the method may be used with a liquid helium bayonet-type cryogenic transfer system. The cryogenic transfer system to be tested comprises an inverted U-shaped transfer line, having a male bayonet for releasable securement to external apparatus. The external apparatus used in conjunction with the test method includes a liquid helium dewar having an inlet female bayonet assembly and related treating and measuring equipment. The external apparatus also includes an exhaust female bayonet assembly with related measuring equipment. One end of the bayonet transfer system is connected to the inlet female bayonet assembly, and the other end is connected to the exhaust female bayonet assembly. The inlet and exhaust female bayonet assemblies used in the test method are of the same type as those employed during normal operation of the cryogenic transfer system. The orientation of the transfer system during operation is preserved during the test, as are the gas columns insulating the male bayonet assemblies.

A heater, installed in a liquid helium dewar, provides the boil-off rate required to provide a flow of gaseous cryogen testing medium through the transfer line. A second heater is installed at the inlet portion of the inlet female bayonet assembly, to temper the gaseous cryogen testing medium entering the system. Thus, the exact operating temperature can be imparted to the test cryogen.

The exhaust female bayonet is provided with an outlet temperature probe, and is connected through an exhaust gas warm-up assembly to a flow meter. The bayonet transfer line assembly is connected between the liquid helium dewar and the flow meter, with the male bayonet assemblies of the transfer system received within the inlet and outlet female bayonet assemblies. The temperature difference between the inlet and outlet portions of the transfer system, and the flow rate through the transfer system, are then measured. The heat capacity of the test cryogen can then be calculated using enthalpy charts. Knowing the heat capacity, mass flow rate and temperature difference, the heat influx can be calculated directly using known thermodynamic relationships.

DETAILED DESCRIPTION OF THE PREFERRED EMBODIMENT

Figure 1:
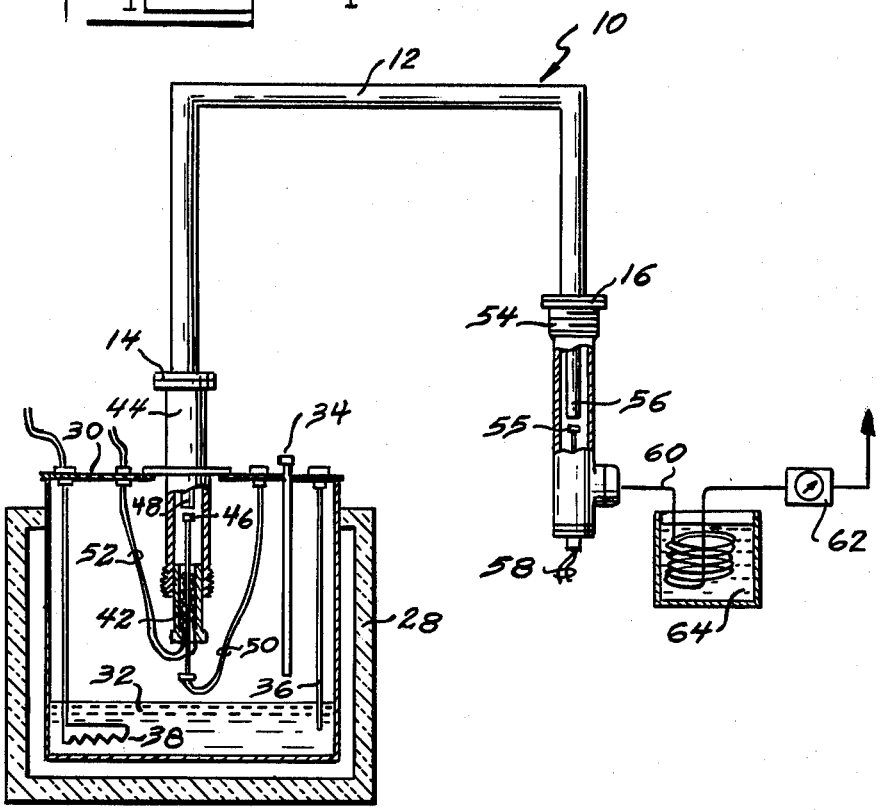
FIG. 1 is a schematic diagram of the test method according to the invention.

Referring now to FIG. 1, test apparatus for measuring the heat influx into a cryogenic transfer system 10 is shown. Transfer system 10 is of conventional construction, and includes a transfer line 12 having male bayonet assemblies 14, 16 at its inlet and outlet, respectively.

Figure 2:
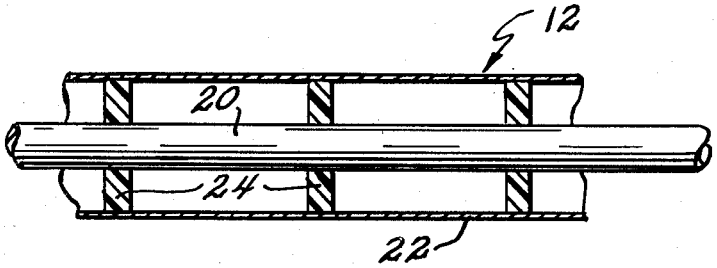
FIG. 2 is a cross-sectional view of a portion of the transfer line of FIG. 1.

As shown in FIG. 2, transfer line 12 comprises an inner conductor or cryogen tube 20, surrounded by an outer tube 22 in contact with the surrounding environment. A separation between tubes 20, 22 is maintained by collar-like spacers 24, formed of a high quality thermal insulating material, such as epoxy fiberglass laminate or Teflon. While inner tube 20 is maintained at cryogenic temperatures, outer tube 22 is maintained at "normal" temperatures, i.e. the temperature of the environment surrounding transfer system 10.

Referring again to FIG. 1, the inlet portion of transfer system 10 is attached to a first portion of test apparatus which includes a conventional cryogen dewar 28. Access to interior portions of dewar 28 is provided by wall 30. Liquid cryogen 32, such as helium, is introduced into dewar 28 through liquid fill port 34, mounted on wall 30, and the level thereof is monitored by liquid level probe 36. A gaseous phase of cryogen 32 comprises the test medium introduced into transfer system 10, and used throughout the heat influx measurement. The gaseous cryogen is produced by heating liquid cryogen 32 with heater 38. Heater 38 is controlled by an external system, not shown, so as to maintain the desired boil-off rate of cryogen 32 as monitored by flow meter 62. The gaseous cryogen test medium is brought to the exact temperature of the cryogen (liquid or gaseous) experienced during normal operation of transfer system 10. This is accomplished by heating the gaseous cryogen with an inlet gas tempering heater 42 located adjacent the inlet transfer system 10.

In the particular arrangement shown in FIG. 1, transfer system 10 is of the bayonet type, equipped with male inlet and outlet bayonet assemblies for easy removable attachment to external apparatus. An inlet female bayonet assembly 44 is mounted to wall 30, for slidable reception of inlet male bayonet assembly 14, so as to allow male bayonet assembly 14 to communicate with interior portions of dewar 28. An inlet temperature probe 46 is installed in female bayonet assembly 44, adjacent an inlet free end 48 of the inner tube 20 of transfer line 12. Connection to temperature probe 46 is provided by conductor 50 which communicates with wall 30. Similarly, connection to heater 42 is provided by conductor 52. Thus, an external circuit, not shown, can be connected between conductors 50, 52 to control heater 42, so as to maintain a predetermined temperature at the inlet to transfer system 10.

Outlet male bayonet assembly 16 is slidably engaged with exhaust female bayonet assembly 54. An outlet temperature probe 55 is installed in female bayonet assembly 54, adjacent an outlet free end 56 of the inner tube 20 of transfer line 12. Conductor 58 provides connection to temperature probe 55. Discharge line 60 provides connection of flow meter 62 with interior portions of exhaust bayonet assembly 54, through exhaust gas warm-up assembly 64. Assembly 64 is provided to accommodate the inlet temperature restrictions of flow meter 62. By use of flow meters capable of operation at cryogenic temperatures, the exhaust gas warm-up assembly 64 of FIG. 1 can be eliminated.

The cryogen gas generated in dewar 28 passes through bayonet connection 14, 44, transfer line 12, bayonet connection 15, 54, and exhaust gas warm-up assembly 64, to reach flow meter 62. The temperature of the cryogen gas at the inlet and outlet of transfer system 10 is monitored by temperature probes 46, 55 respectively. The mass flow rate of the cryogen gas passing through transfer system 10 is measured by flow meter 62. The heat influx entering transfer system 10 can be calculated directly by using the thermodynamic relation $$Q = \dot{m} \int_{T_i}^{T_o} C_p \, dT,$$

where Q is the heat influx into system 10, $\dot{m}$ is the mass flow rate of the cryogen gas flow through system 10, dT is the temperature difference along the transfer system, $T_i$ is the inlet temperature, $T_o$ is the outlet temperature, and $C_p$ is the specific heat capacity at constant pressure of the gaseous cryogen flowing through system 10, as determined by tables of thermodynamic functions for the test cryogen.

Thus, by using the measurement method of the present invention, the heat influx entering transfer system 10 is directly determined under actual operating conditions. One advantage in using this method is that the normal operating thermal connections to the transfer system are maintained during testing. With reference to the particular system described above, a column of cryogen gas between inlet bayonet assemblies 44, 48 and between exhaust bayonet assemblies 54, 56 are maintained, thereby closely simulating the heat influx to these portions experience during normal operation. Another advantage is realized in that the normal operating cryogen can be used for the test measurement. This eliminates the need for empirical correlations based on tenuous assumptions, as required when nitrogen is used to measure heat influx of a helium system, for example.

The above method which employs a gaseous cryogen, provides accurate measurement of heat influx, even if the transfer line normally carries the cryogen in liquid form, during actual operation. In this application of the test method, the gaseous cryogen at the inlet to the system to be measured, must be maintained at the temperature of the liquid cryogen, but the flow rate of liquid cryogen during operation need not be maintained, as well established thermodynamic relationships can be applied to obtain an accurate heat influx measurement at reduced flow rates.

The embodiment shown has utilized a bayonet-type transfer line. This is not a prerequisite for practicing the herein disclosed measurement method. Any transfer line that contains a flow of cryogen can be measured using the method described above.

The embodiments of this invention in which an exclusive property or privilege is claimed are defined as follows:

1. A method for measuring the heat influx of a cryogenic transfer system comprising the steps of:

establishing a flow of gaseous cryogen through said transfer system;

measuring the temperature of said gaseous cryogen at an inlet and an outlet of said transfer system;

measuring the mass flow rate of said gaseous cryogen;

calculating the heat capacity of said gaseous cryogen; and calculating the heat influx of said transfer system by using the equation $$Q = \dot{m} \int_{T_i}^{T_o} C_p \, dT,$$

where Q is the heat influx to the transfer system, $\dot{m}$ is the mass flow rate of gaseous cryogen through the system, $C_p$ is the specific heat capacity at constant pressure of the gaseous cryogen, $T_i$ and $T_o$ are the inlet and outlet temperatures of the transfer system, respectively, and dT is the temperature differential along the transfer system.

2. The method of claim 1 wherein said cryogenic transfer system comprises a cryogenic transfer line having at least one end thereof terminated in a bayonet connector.

3. The method of claim 1 wherein said cryogen comprises helium.

4. The method of claim 1 wherein a liquid cryogen dewar is connected to the inlet of said transfer system and said flow of gaseous cryogen through said transfer system is established by boiling off a liquid cryogen in said liquid cryogen dewar.

5. The method of claim 4 wherein the gaseous cryogen flowing through said inlet is tempered by heating means to a predetermined inlet temperature.

6. The method of claim 5 wherein the outlet of said transfer system includes a bayonet connector, and said liquid cryogen dewar is connected to the inlet of said transfer system through a bayonet connector.

7. The method of claim 6 wherein the outlet of said transfer system is connected to a female bayonet connector, and said female bayonet connector includes a temperature probe for measuring the outlet temperature of said transfer system.

8. The method of claim 7 wherein said bayonet connector connecting said liquid cryogen dewar to said inlet of said transfer system includes a temperature probe for measuring the inlet temperature of said transfer system.

9. The method of claim 8 wherein said cryogen comprises helium.

* * * * *